US006942838B1

(12) United States Patent
Morishita

(10) Patent No.: US 6,942,838 B1
(45) Date of Patent: Sep. 13, 2005

(54) EMISSION SYSTEM PART AND METHOD OF MANUFACTURING THE PART

(75) Inventor: Michio Morishita, Toyota (JP)

(73) Assignee: Sango Co., Ltd., Aichi-ken (JP)

( * ) Notice: Subject to any disclaimer, the term of this patent is extended or adjusted under 35 U.S.C. 154(b) by 0 days.

(21) Appl. No.: 09/701,255

(22) PCT Filed: May 25, 1999

(86) PCT No.: PCT/JP99/02739

§ 371 (c)(1),
(2), (4) Date: Nov. 27, 2000

(87) PCT Pub. No.: WO99/61764

PCT Pub. Date: Dec. 2, 1999

(30) Foreign Application Priority Data

May 28, 1998 (JP) ..... 10-146760

(51) Int. Cl.[7] ..... B01D 50/00; B01D 53/34
(52) U.S. Cl. ..... 422/179; 422/177
(58) Field of Search ..... 422/179, 177, 422/168, 181; 95/47, 51; 96/375

(56) References Cited

U.S. PATENT DOCUMENTS 3,991,254 A 11/1976 Takeuchi
5,849,250 A * 12/1998 Timko ..... 422/177
5,849,251 A * 12/1998 Timko ..... 422/177
2002/0096225 A1 * 7/2002 Ishizu et al. ..... 138/114
2004/0050618 A1 * 3/2004 Marocco ..... 181/248

FOREIGN PATENT DOCUMENTS

| | | |
|---|---|---|
| JP | 57-038557 | 8/1982 |
| JP | 63-045533 | 11/1988 |
| JP | 1-011937 | 4/1989 |
| JP | 6-101465 | 4/1994 |
| JP | 08200050 | 8/1996 |
| JP | 9-108576 | 4/1997 |
| JP | 09 112259 | 4/1997 |
| JP | 09 155202 | 6/1997 |

* cited by examiner

*Primary Examiner*—M. Alexandra Elve
(74) *Attorney, Agent, or Firm*—Stevens, Davis, Miller & Mosher, LLP

(57) ABSTRACT

An emission system part, comprising an inner pipe in which a space is formed contiuously up to the tapered reduced diameter parts of inner and outer pipes and which incorporates a catalyst carrier at its center part and forms a generally tapered reduced diameter part of its center part. Spin working forms the part.

4 Claims, 8 Drawing Sheets

EMISSION SYSTEM PART AND METHOD OF MANUFACTURING THE PART

DESCRIPTION

1. Technical Field

The present invention relates to parts in an exhaust system and a method of producing the parts.

2. Background Art

In parts in an exhaust system such as a muffler, a catalyst converter and the like of an internal combustion engine, there is frequently employed a heat insulating double structure in which an inner pipe having both end portions reduced so as to be formed in a taper shape and an outer pipe having both end portions reduced so as to be formed in a taper shape are arranged with an air gap therebetween.

For example, as shown in FIG. 8, there is a catalyst converter in which a metal outer pipe 105 having taper-like reduced diameter portions 104 at both end portions is arranged on an outer periphery of a metal inner pipe 103 containing a catalyst carrier 101 and having taper-like reduced diameter portions 102 at both end portions so as to provide a gap 106 between the inner pipe 103 and the outer pipe 105. In this structure, a light off characteristic of a catalyst is improved by a heat insulating effect of the gap 106 and an exhaust gas purifying performance is improved. A catalyst converter having the structure mentioned above is, for example, disclosed in Japanese Patent Unexamined Publication No. 6-101465.

However, it is impossible to insert the inner pipe 103 structured such as to be expanded in a diametrical direction at a middle portion and have the reduced diameter portions 102 at both end portions into the outer pipe 105 expanded in a diametrical direction at a middle portion and having the reduced diameter portions 104 at both end portions so as to assemble them.

Accordingly, as a method of producing the double pipe mentioned above, there can be employed a general producing method comprising the steps of forming outer pipes having a shape reduced at both end portions in a hollow shape and in a double-split manner in an axial direction of the pipe, arranging them on an outside of a previously formed inner pipe while holding a gap between the inner pipe and the outer pipes, and bonding the outer pipes formed in the double-split manner to each other by a welding or the like. However, in the producing method, there is a problem that a cost is increased due to pressing dies, a welding process or the like.

In order to solve the problem mentioned above, for example, as shown in FIG. 9, there is a catalyst converter structured such that a large-diameter portion 202 is formed in one end portion of the inner pipe 201, a small-diameter portion 204 is formed in an end portion of the outer pipe 203 opposing to the large-diameter portion 202 of the inner pipe, and the inner and outer pipes 201 and 203 are fitted to each other so as to bring the large-diameter portion 202 and the outer pipe 203 into contact with each other and bring the small-diameter portion 204 and the inner pipe 201 into contact with each other, thereby holding the gap 205 between the inner and outer pipes 201 and 203. This structure is disclosed, for example, in Japanese Patent Unexamined Publication No. 9-108576.

In the catalyst converter mentioned above, since it is necessary to provide the taper-like reduced diameter portions in both end portions thereof, taperlike diffusers 206 and 207 are provided in both ends of the structure obtained by combining the inner and outer pipes, in the structure shown in FIG. 9.

This is because it is necessary to connect an independent diffuser since the reduced diameter portions can not be previously formed in and fitted to both ends of the inner and outer pipes.

Accordingly, in this structure, the gap 205 can be formed only between the inner pipe 201 and the outer pipe 203 where the catalyst carrier 208 exists, and no gap can be formed in the taper portions (diffuser portions) of both end portions. Further, since the inner and outer pipes 201 and 203 are bonded in the portion near the catalyst carrier 208, a heat transmission is performed in the portion near the catalyst carrier.

Accordingly, in comparison with the catalyst converter having the gap 106 extending to both of the taper-like reduced diameter portions 102 and 104, as shown in FIG. 8, the catalyst converter shown in FIG. 9 has a low heat insulating effect and an expected heat insulating effect can not be obtained, so that it is difficult to reduce a time required for activation of the catalyst.

DISCLOSURE OF THE INVENTION

Accordingly, an object of the present invention is to provide parts in an exhaust system in which a gap is formed in series to both of taper-like reduced diameter portions of inner and outer pipes as shown in FIG. 8 mentioned above, and a method of easily and inexpensively producing the parts in the exhaust system.

In order to achieve the object mentioned above, in accordance with the present invention, there is provided parts in an exhaust system comprising:

an inner pipe containing a catalyst carrier in a center portion and having substantially taper-like reduced diameter portions formed in both end portions of the center portion; and an outer pipe having substantially taper-like reduced diameter portions integrally formed in both end portions of a center portion corresponding to the center portion of the inner pipe and provided on an outer periphery of the inner pipe in such a manner as to have a gap between the outer pipe and the inner pipe all over the area including the reduced diameter portions in both end portions and the center portion, wherein the reduced diameter portions in both end portions of the outer pipe are formed in accordance with a spinning process.

Further, in the parts in the exhaust system in accordance with the present invention, the structure may be made such that a heat insulating member or a damper member is interposed in at least a part within the gap.

Further, in accordance with the present invention, there is provided a method of producing parts in an exhaust system comprising the steps of:

fitting an outer pipe on an outer side of an inner pipe containing a catalyst carrier in a center portion and having substantially taper-like reduced diameter portions formed in both end portions of the center portion while holding a gap between the outer pipe and the inner pipe; and applying a spinning process in such a manner as to have a gap between both end portions of the outer pipe and the reduced diameter portion in the inner pipe so as to reduce both end portions of the outer pipe in a substantially taper shape.

Further, in the method of producing the parts in the exhaust system in accordance with the present invention, the structure may be made such that a heat insulating member or a damper member is interposed in at least a part between the inner pipe and the outer pipe at said step of fitting the outer pipe.

BRIEF DESCRIPTION OF THE DRAWINGS

FIGS. 1A and 1B show an embodiment of parts in an exhaust system in accordance with the present invention, in which FIG. 1A is a vertical cross sectional view of the same and FIG. 1B is a cross sectional view taken along a line 1B—1B in FIG. 1A;

BEST MODE FOR CARRYING OUT THE INVENTION

A description will be given of embodiments in accordance with the present invention on the basis of an embodiment shown in FIGS. 1A to 7C.

Figure 1A:
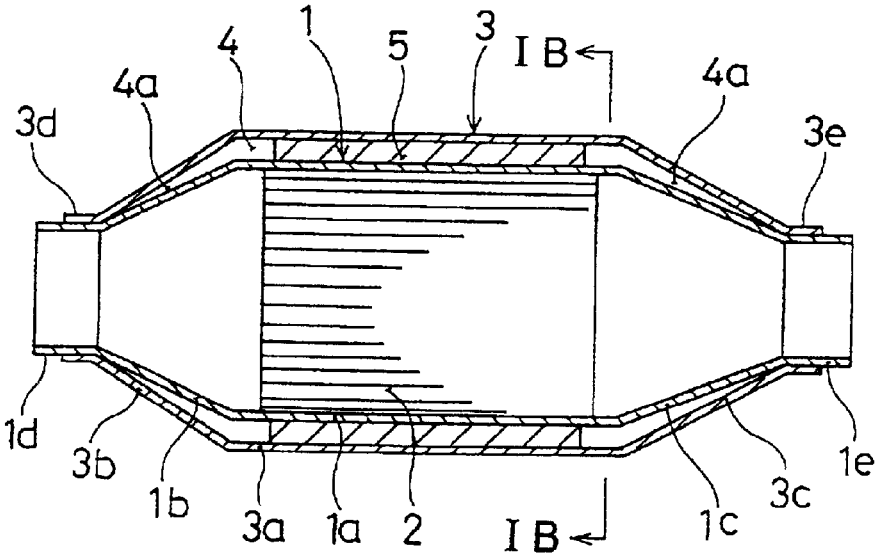
Figure 1B:
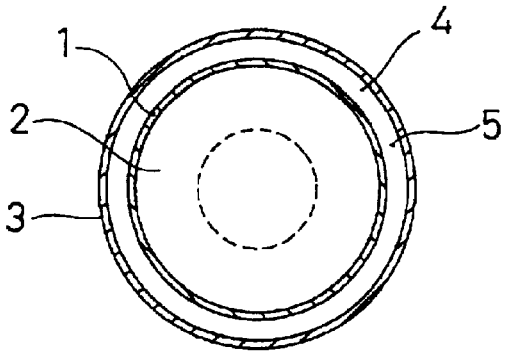

FIGS. 1A, 1B and 2A to 2D show a first embodiment in which the present invention is applied to a catalyst converter. FIGS. 1A and 1B are vertical cross sectional views of the catalyst converter in accordance with the present invention. A center portion l*a* of a metal inner pipe 1 is formed in a circular pipe shape, and a catalyst carrier 2 is inserted and received within the center portion 1*a*. Substantially taper-like reduced diameter portions (cone portions) 1*b* and 1*c* in which a pipe wall of the inner pipe 1 is inward deformed are integrally formed in both end portions of the inner pipe 1, and cylindrical connection portions 1*d* and 1*e* are integrally formed in front portions of both of the reduced diameter portions 1*b* and 1*c*.

An outer pipe 3 having a cylindrical center portion 3*a* with a diameter larger than the center portion 1*a* of the inner pipe 1 is fitted on an outer side of the inner pipe 1, and a center gap 4 is formed between both of the center portions 1*a* and 3*a*.

Both end portions in the outer pipe 3, that is, the portions corresponding to the outer peripheries of the reduced diameter portions 1*b* and 1*c* in the inner pipe 1 are integrally formed in such a manner as to construct inward deformed substantially taper-like reduced diameter portions (cone portions) 3*b* and 3*c*, and cylindrical connection portions 3*d* and 3*e* reduced so as to be close attached to the outer periphery of the connection portions 1*d* and 1*e* of the inner pipe 1 are integrally formed in front portions of both of the reduced diameter portions 3*b* and 3*c*.

Tapered side gaps 4*a* and 4*a* formed so that an interval of the gap is made narrower as moving toward the front end portion are formed between the taper-like reduced diameter portions 1*b* and 1*c* of the inner pipe 1 and the taper-like reduced diameter portions 3*b* and 3*c* of the outer pipe 3, and both of the side gaps 4*a* and 4*a* are formed in series with the center gap 4.

A heating insulating member 5 is received within the center gap 4, and the heat insulating member 5 is held between the inner and outer pipes 1 and 3.

Next, a description will be given of a method of producing the catalyst converter shown in FIGS. 1A and 1B with reference to FIGS. 2A to 2D.

Figure 2A:
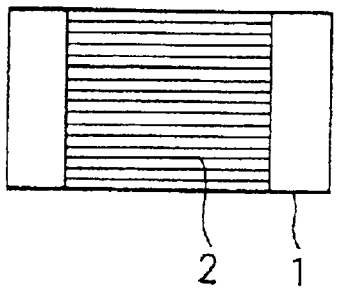
FIGS. 2A to 2D are cross sectional views which show an embodiment of producing steps in accordance with the present invention.

At first, the catalyst converter 2 is inserted into the cylindrical inner pipe 1 in which both end portions are open, from one open end, as shown in FIG. 2A. In this case, although an illustration is omitted, a catalyst holding mat made of ceramics is inserted between the inner pipe 1 and the catalyst carrier 2.

Figure 2B:
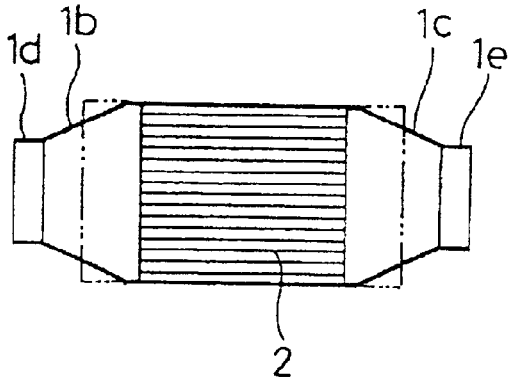

Next, the taper-like reduced diameter portions 1*b* and 1*c* are formed by reducing both end portions of the inner pipe 1 in accordance with a reducing process as shown in FIG. 2B. Further, the cylindrical connection portions 1*d* and 1*e* are formed in the front portion thereof.

Figure 2C:
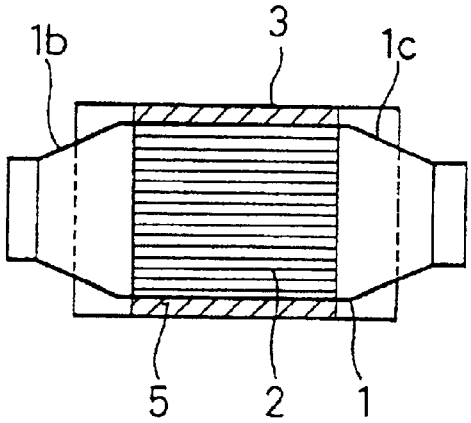

Then, the cylindrical outer pipe 3 in which a diameter thereof is larger than the outer diameter of the inner pipe 1 and both end portions thereof is open is fitted onto the outer periphery of the inner pipe 1 as shown in FIG. 2C. At this time, the heat insulating member (the heat insulating mat) 5 is interposed between the inner pipe 1 and the outer pipe 3 as shown in FIG. 2C if necessary.

Figure 2D:
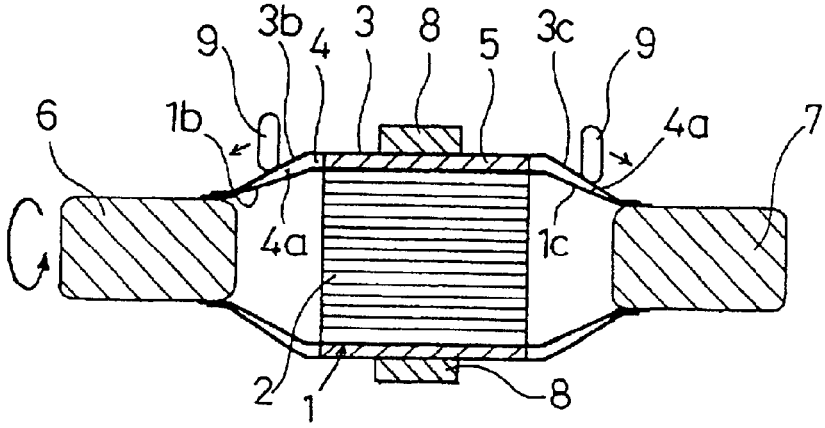

Next, as shown in FIG. 2D, in a spinning machine structured such that inner pipe supporting devices 6 and 7 and an outer pipe supporting device 8 are coaxially provided so as to be rotated in the same direction at the same speed in connection therewith, the inner pipe supporting devices 6 and 7 are fitted into reduced both end bore portions of the inner pipe 1 so as to support the inner pipe 1, and the outer periphery of the center portion of the outer pipe 3 is supported in such a manner as to be coaxial with the inner pipe 1 by the outer pipe supporting device 8. Accordingly, even in the case that the heat insulating member 5 is not provided, an annular gap 4 having a predetermined size can be held between the inner and outer pipes 1 and 3.

Then, both end portions of the outer pipe 3 are reduced so as to be plastically deformed by the spinning roller 9, whereby the taper-like reduced diameter portions 3*b* and 3*c* are formed. At this time, by positioning with reference to the both end bore portions of the inner pipe 1, it is possible to deform the taper-like reduced diameter portions 3*b* and 3*c* of the outer pipe 3 so as to preciously keep the gap 4*a* with respect to the taper-like reduced diameter portions 1*b* and 1*c* of the inner pipe 1, and it is possible to dispose the bore portions along the bore portions of the inner pipe 1.

Further, the front portions of both taperlike reduced diameter portions 3*b* and 3*c* in the outer pipe 3 are pressed by the spinning roller 9 so as to be pressed to the outer peripheral surfaces of the connection portions 1*d* and 1*e* in the inner pipe 1 and plastically deformed, and the inner and outer pipes 1 and 3 are integrally structured by connecting the pressed connection portions 3*d* and 3*e* to the connection portions 1*d* and 1*e* of the inner pipe 1.

Figure 9:
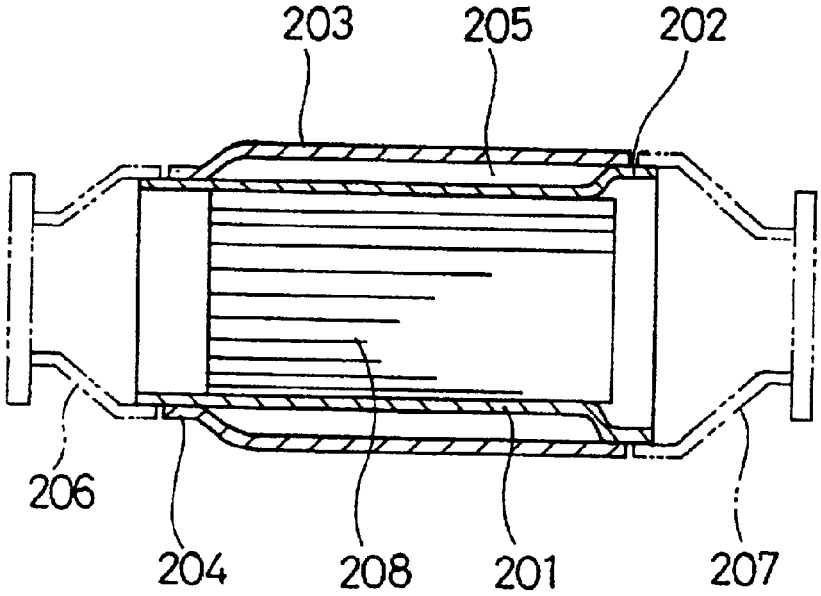
FIG. 9 is a vertical cross sectional view which shows a structure of another conventional catalyst converter.

In accordance with the producing method mentioned above, the side gap 4a is also provided in the taper-like reduced diameter portion corresponding to the cone portion, the side gap 4*a* is communicated with the center gap 4, and a contact portion between the inner and outer pipes 1 and 3, that is, a heat transmitting portion is placed at a position far apart from the catalyst carrier 2 in an axial direction. Accordingly, a heat insulating characteristic due to the gaps 4 and 4*a* is made higher than that of the structure shown in FIG. 9, and a desired heat insulating effect can be obtained. Further, a heat insulating effect can be further increased by interposing the adiabatic member 5.

Figure 3A:
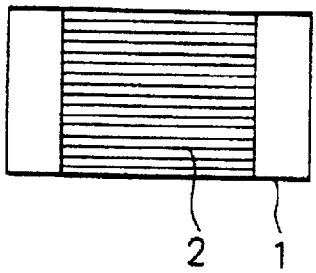
FIGS. 3A to 3D are cross sectional views which show another embodiment of producing steps in accordance with the present invention.
Figure 3B:
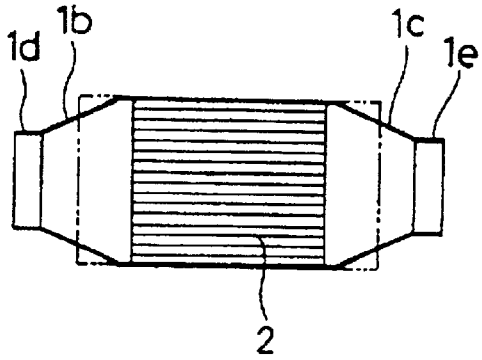
Figure 3C:
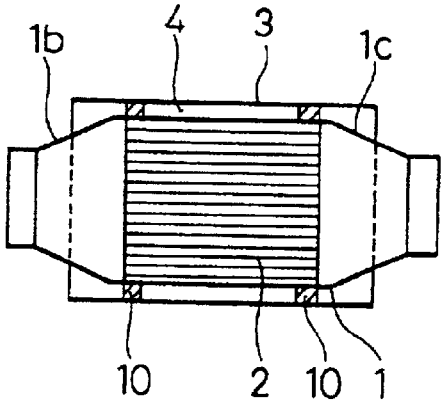
Figure 3D:
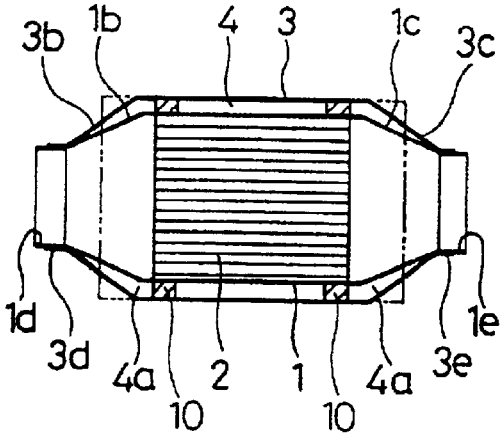

FIGS. 3A to 3D show an embodiment structured such that a damper member, for example, a wire mesh 10 made of a metal small wire is interposed between the inner and outer pipes 1 and 3 at a position corresponding to both axial end portions of the catalyst carrier 2, in place of the heat insulating member (the heat insulating mat) 5 mentioned above, as shown in FIG. 3C. The other structures and producing methods are the same as those mentioned above.

In accordance with the embodiment, the damper member 10 can prevents the inner pipe 1 and the outer pipe 3 from being brought into contact with each other due to vibration.

FIGS. 4A to 4E show an embodiment structured such that a member evanished due to heating, for example, a supporting member 11 made of a paper or the like is interposed in place of the damper member 10. The other structures and producing methods are the same as those mentioned above.

Figure 4A:
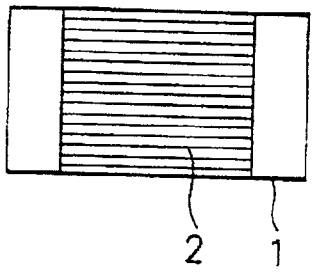
FIGS. 4A to 4E are cross sectional views which show the other embodiment of producing steps in accordance with the present invention.
Figure 4B:
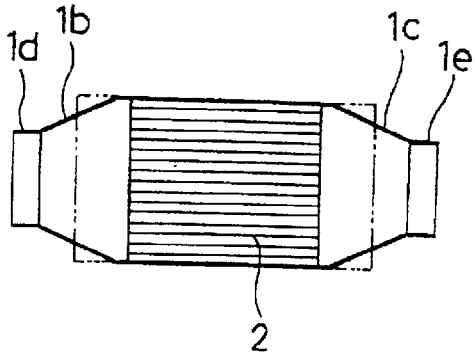
Figure 4C:
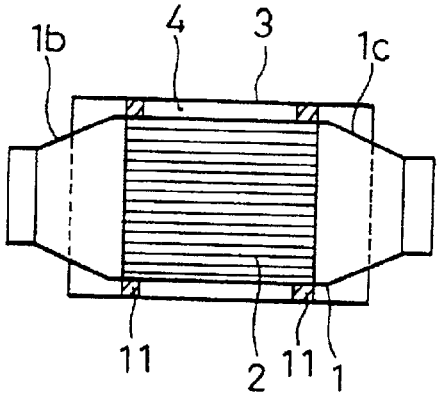
Figure 4D:
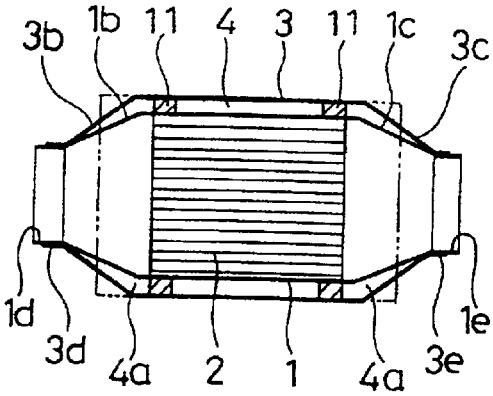
Figure 4E:
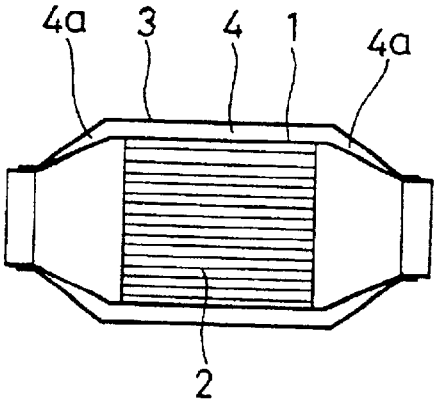

In accordance with the embodiment, the outer pipe 1 can be held at the position having a predetermined gap by the supporting member 11 at the production time explained in FIGS. 2A to 2D mentioned above, and the supporting member 11 is carbonized and evanished by heating after production, so that the gap with which the central gap 4 and both side gaps 4*a* are communicated are formed as shown in FIG. 4E.

Figure 5:
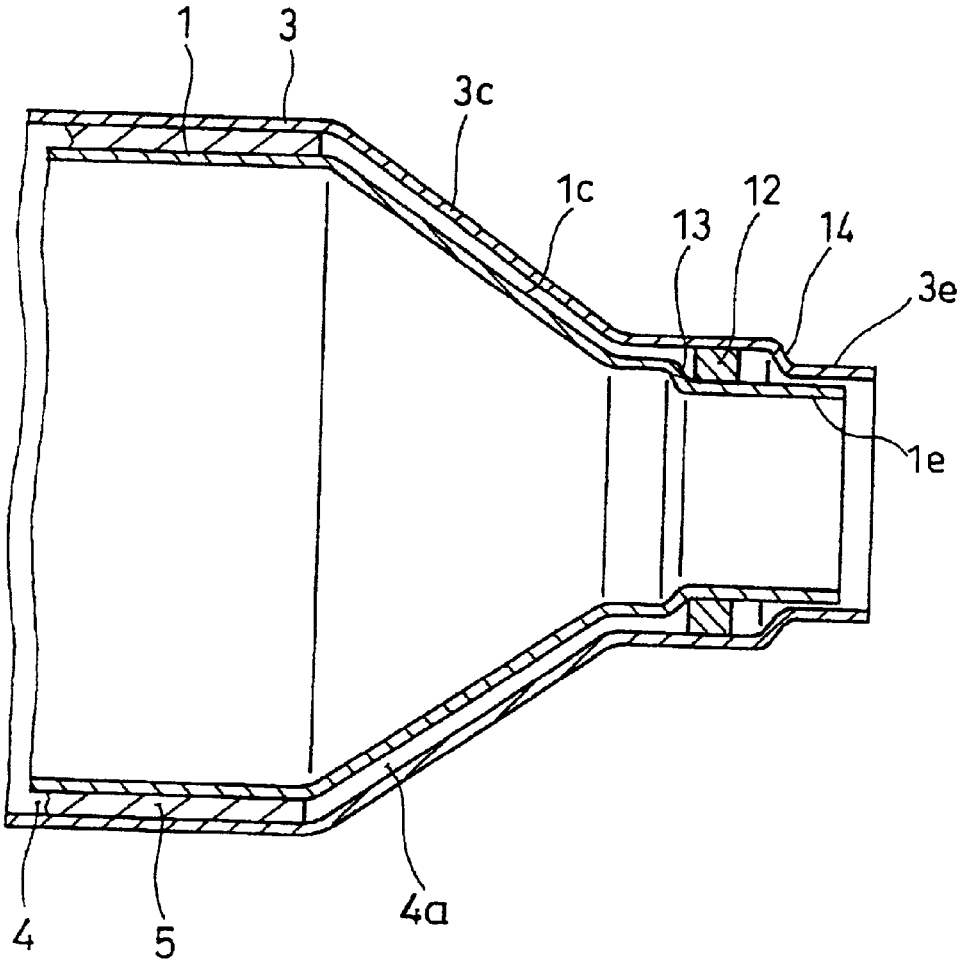
FIG. 5 is a partly enlarged cross sectional view which shows another example of an interposed state of a damper member in an embodiment according to the present invention.

FIG. 5 shows an embodiment structured such that a damper member, for example a wire mesh 12 made of a metal small wire is interposed between the connection portions 1*d* and 3*d,* and 1*e* and 3*e* (only the 1*e* and 3*e* side is shown in FIG. 5). That is, a step portion 13 due to drawing is formed at a position shown in FIG. 5 of the connection portions 1*d* and 1*e* of the inner pipe 1, a step portion 14 due to drawing is formed at a position shown in FIG. 5 of the connection portions 3*d* and 3*e* of the outer pipe 3, and the wire mesh 12 is interposed between the step portions 13 and 14.

In accordance with the present embodiment, it is possible to prevent the inner pipe 1 and the outer pipe 3 from being brought into contact with each other due to vibration by the damper member 12 and it is possible to prevent the damper member 12 from falling out by the step portions 13 and 14. Further, as shown in FIG. 5, by forming the inner pipe 1 and the outer pipe 3 so that they can relatively slide in an axial direction, it is possible to intend to reduce a stress due to a difference of thermal expansion caused by a temperature difference between the inner pipe 1 and the outer pipe 3, whereby it is possible to improve a durability.

In each of the embodiments mentioned above, both end portions of the outer pipe 3 are reduced in accordance with the spinning process after the outer pipe is fitted on the inner pipe. However, the structure may be made such that one end portion of the outer pipe 3 is previously reduced in accordance with the spinning process, the inner pipe 1 having reduced both end portions is inserted from another end portion which is not reduced, whereby the outer pipe is fitted on the inner pipe, and thereafter, another end portion of the outer pipe 3 is reduced in accordance with the spinning process.

Figure 6A:
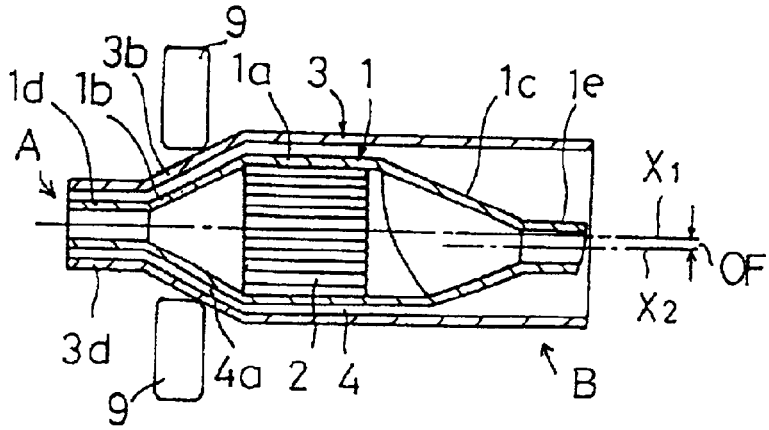
FIGS. 6A to 6C are cross sectional views which show the other embodiment of producing steps in accordance with the present invention.
Figure 6B:
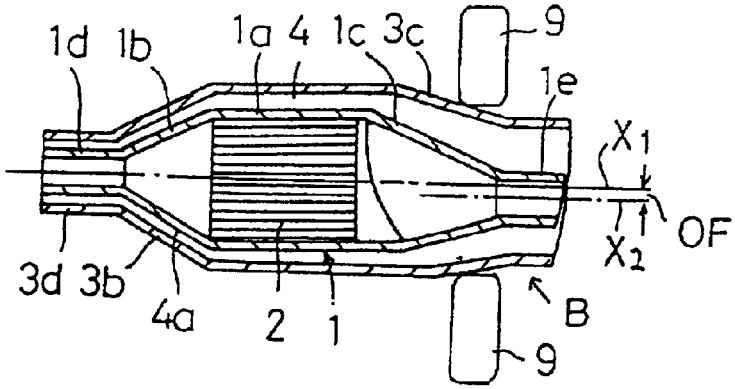
Figure 6C:
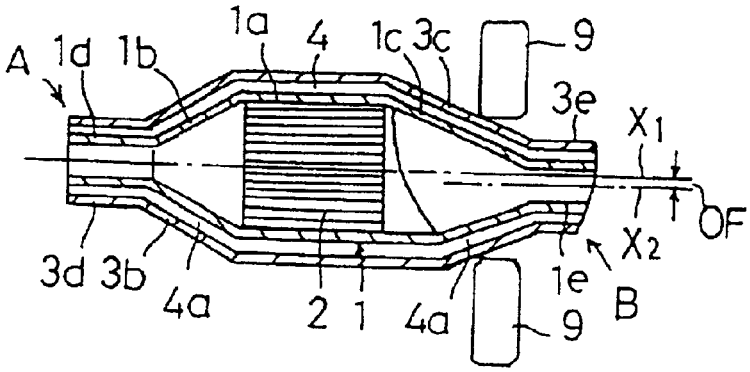

FIGS. 6A to 6C show an embodiment for producing parts in an exhaust system in which, with respect to an axis X1 of the connection portions 1*d* and 3*d* of one end portion A in the inner pipe 1 and the outer pipe 3, an axis X2 of the connection portions 1*e* and 3*e* of another end portion B is eccentric at a predetermined amount.

In producing steps of the embodiment, at first, as shown in FIG. 6A, the taper-like reduced diameter portions 1*b* and 1*c* and the cylindrical connection portions 1*d* and 1*e* are continuously reduced and formed in both end portions of the center portion 1*a* in the inner pipe, and there is formed the inner pipe 1 structured such that the axis X2 of the taperlike reduced diameter portion 1*c* and the connection portion 1*e* in the another end portion is eccentric at a predetermined amount OF with respect to the axis X1 of the taper-like reduced diameter portion 1*b* and the connection portion 1*d* in the one end portion A.

The outer pipe 1 which is not reduced is supported by the supporting device on the outer periphery of the inner pipe 1 supported by the supporting device so as not to rotate, in such a manner as not to rotate with the predetermined gap 4 therebetween, so as to fit the outer pipe on the inner pipe.

In this embodiment, the spinning roller 9 is structured such that a plurality of spinning rollers 9 two spinning rollers are shown in the illustrated embodiment) are arranged in a peripheral direction around the axis X1, and each of the spinning rollers 9 can rotate on its own axis, revolves around the axis X1 and moves in a direction perpendicular to the axis X1 and the axial direction.

Accordingly, on the outer peripheral surface of the one end portion A, the spinning roller 9 revolving around the axis X1 is moved in a centripetal direction and the direction of the axis X1 so as to form the taper-like reduced diameter portion 3*b* and the cylindrical connection portion 3*d* fitted to each other with a predetermined gap 4*a* on the outer periphery of the taper-like reduced diameter portion 1*b* and the connection portion 1*d* as shown in FIG. 6A.

Next, as shown in FIG. 6B, the reducing process at a predetermined amount as shown in FIG. 6B is performed by coinciding the axis X2 of the connection portion 1*e* of the inner pipe 1 in the another end portion B with the axis of revolution of the spinning roller 9 and moving the spinning roller 9 revolving around the outer peripheral surface of the another end portion B of the outer pipe 3 in the centripetal direction and the direction of the axis X2. The taperlike reduced diameter portion 3*c* of the another end portion B of the outer pipe 3 is finally reduced and formed in the outer peripheral portion of the taperlike reduced diameter portion 1*c* of the inner pipe 1 with the predetermined gap 4*a* and the connection portion 3*e* is reduced and formed in the outer peripheral portion of the connection portion 1*e* of the inner pipe 1 with the predetermined gap as shown in FIG. 6C by repeating the steps at one or more times.

Accordingly, there can be obtained the parts in the exhaust system in which the axis X2 of the connection portions le and 3e of the another end portion B is eccentric with respect to the axis Xl of the connection portions 1*d* and 3*d* of the one end portion A in the inner pipe 1 and the outer pipe 3 at the predetermined amount OF, as shown in FIG. 6C.

In this case, the supporting devices of the inner pipe 1 and the outer pipe 3 are omitted.

Figure 7A:
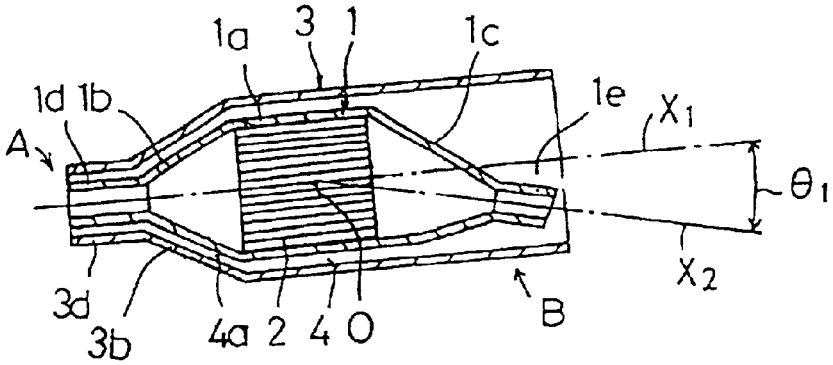
FIGS. 7A to 7C are cross sectional views which show the other embodiment of producing steps in accordance with the present invention.
Figure 7B:
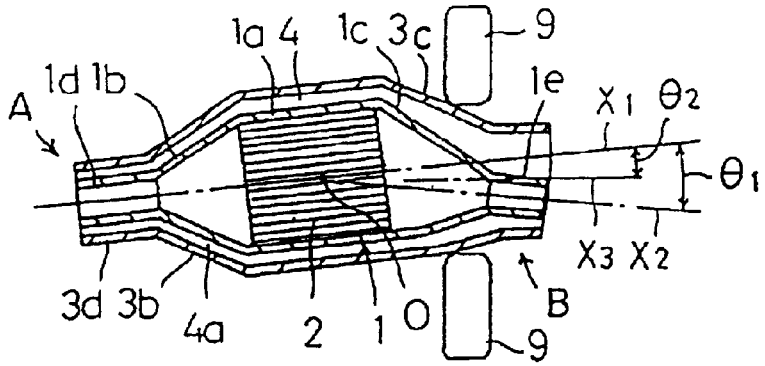
Figure 7C:
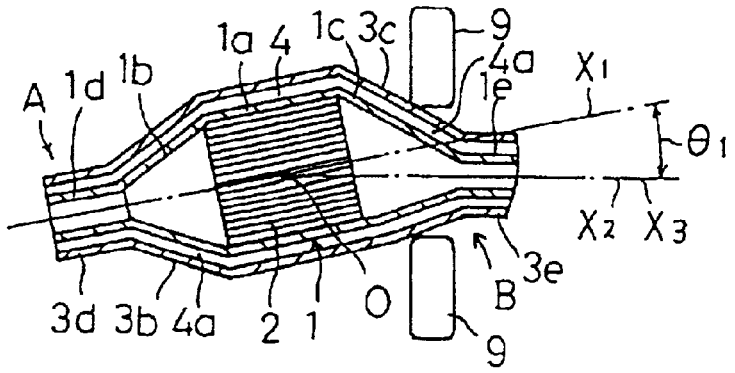
Figure 8:
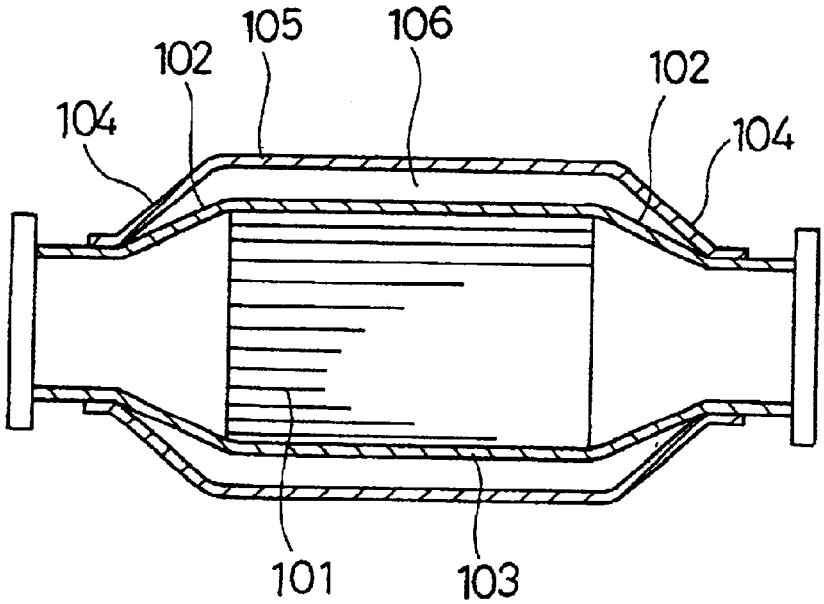
FIG. 8 is a vertical cross sectional view which shows a structure of a conventional catalyst converter.

FIGS. 7A to 7C show an embodiment for producing parts in an exhaust system in which, with respect to an axis X1 of the connection portions 1*d* and 3*d* of one end portion A in the inner pipe 1 and the outer pipe 3 in the parts in the exhaust system shown in FIGS. 6A to 6C, an axis X2 of the connection portions 1*e* and 3*e* is bent at a predetermined angle.

In producing steps of the embodiment, at first, as shown in FIG. 7A, the taper-like reduced diameter portions 1*b* and 1*c* and the cylindrical connection portions 1*d* and 1*e* are continuously formed in both end portions of the center portion 1*a* in the inner pipe, and there is formed the inner pipe 1 structured such that the axis X2 of the taper-like reduced diameter portion 1*c* and the connection portion 1*e* in the another end portion is oblique at a predetermined angle 0 with respect to the axis X1 of the taper-like reduced diameter portion 1*b* and the connection portion 1*d* in the one end portion A.

Next, as well as FIG. 6A, the outer pipe 3 which is not reduced is fitted on the inner pipe 1, the inner and outer pipes 1 and 3 are supported so as not to rotate, and the one end portion A thereof is reduced by the spinning roller 9 in the same manner as mentioned above, as shown in FIG. 7A.

Then, the outer pipe 3 into which the inner pipe 1 is fitted is set so that the axis X1 thereof is oblique at a predetermined angle θ2 with respect to an axis X3 of revolution of the spinning roller 9, and a reducing process is performed at a predetermined amount, as shown in FIG. 7B, by moving the spinning roller 9 revolving around the axis X3 on the outer peripheral surface of the another end portion B of the outer pipe 3 in the centripetal direction and the direction of the axis X3.

Next, the inner and outer pipes 1 and 3 are further rotated around a center portion 0 thereof from a state in FIG. 7B, and as shown in FIG. 7C, the spinning process is performed by coinciding the axis X2 of the connection portion 1*e* of the another end portion B in the inner pipe 1 with the axis X3 of revolution of the spinning roller 9 as shown in FIG. 7C, and the taper-like reduced diameter portion 3*c* of the another end portion B in the outer pipe 3 is reduced and formed in the outer peripheral portion of the taper-like reduced diameter portion 1*c* in the inner pipe 1 with a predetermined gap 4*a* as shown in FIG. 7C, and the connection portion 3*e* is reduced and formed in the outer peripheral portion of the connection portion 1*e* in the inner pipe 1 with a predetermined gap.

Accordingly, there can be obtained the parts in the exhaust system in which the axis X2 of the connection portions 1*e* and 3*e* of the another end portion B is oblique at the predetermined angle 61 with respect to the axis Xl of the connection portions 1*d* and 3*d* of the one end portion A in the inner pipe 1 and the outer pipe 3, as shown in FIG. 7C.

In this case, in the embodiments shown in FIGS. 6A to 6C and FIGS. 7A to 7C, the compressed both end portions of the formed inner pipe 1 and outer pipe 3 are connected to the inner and outer pipes such as a connected double exhaust pipe or the like, whereby the gaps 4 and 4*a* between the inner pipe 1 and the outer pipe 3 can be kept.

Further, in the embodiments in FIGS. 6A to 6C and FIGS. 7A to 7C, the connection portions 3*d* and 3*e* of the outer pipe 3 may be bonded to the connection portions 1*d* and 1*e* of the inner pipe 1.

INDUSTRIAL APPLICABILITY

As mentioned above, in accordance with the present invention, since the structure is made such that the portions to be reduced in both end portions of the outer pipe are formed by reducing them in accordance with the spinning process; it is possible to easily form the parts in the exhaust system in which both end portions are reduced to the outer periphery of the inner pipe in which both end portions are reduced so as to bond the reduced diameter ends of the outer pipe to the reduced diameter ends of the inner pipe or to be apart the former from the latter and the gap is formed between the inner pipe and the outer pipe all along both reduced diameter portions of the outer pipe. Further, it is possible to integrally form the outer pipe with no joints not only in a whole length in the axial direction thereof but also in the peripheral direction.

Further, since the inner pipe and the outer pipe can be bonded to each other by a plastic deformation in accordance with the spinning process, the inner pipe and the outer pipe can be connected without using a welding process or a pressing process.

Further, a heat insulating performance can be improved by interposing the heat insulating member in the gap between the inner and outer pipes. Further, it is possible to prevent the inner pipe and the outer pipe from being brought into contact with each other due to vibration by interposing the damper member.

Further, in accordance with the producing method including the step of fitting the outer pipe on the outer side of the inner pipe containing the catalyst carrier in the center portion and having the substantially taper-like reduced diameter portions formed in both end portions of the center portion while holding the gap, and the step of applying the spinning process in such a manner as to have the gap between both end portions of the outer pipe and the reduced diameter portion in the inner pipe so as to reduce both end portions of the outer pipe in the substantially taper shape, the parts in the exhaust system mentioned above can be easily produced.

Furthermore, by producing the parts in the exhaust system in such a manner as to interpose one of the heat insulating member and the damper member in at least a part between the inner pipe and the outer pipe at a time of fitting the outer pipe on the inner pipe, it is possible to easily produce the parts in the exhaust system in which the heat insulating member or the damper member is interposed within the gap.

What is claimed is:

1. Parts in an exhaust system comprising:

an inner pipe formed from a cylindrical pipe, containing a catalyst carrier in a center portion and having substantially taper-like reduced diameter portions integrally formed in both end portions of the center portion; and an outer pipe formed from a cylindrical pipe, having substantially taper-like reduced diameter portions integrally formed in both end portions of a center portion fitted on the center portion of said inner pipe and provided on an outer periphery of the inner pipe in such a manner as to have a gap between the outer pipe and said inner pipe all along an area including the reduced diameter portions in both end portions, wherein the reduced diameter portions in both end portions of said outer pipe are formed with cylindrical portions at front portions of said reduced diameter portions in accordance with a spinning process, and an inner surface of said front end portion thereof is closely attached to an outer surface of the inner pipe or an interposed material.

2. Parts in an exhaust system as claimed in claim 1, wherein one of a heat insulating member and a damper member is interposed as the interposed material in at least a part within said gap.

3. A method of producing parts in an exhaust system comprising:

fitting an outer pipe on an outer side of an inner pipe formed from a cylindrical pipe, containing a catalyst carrier in a center portion and having substantially taper-like reduced diameter portions formed in both end portions of the center portion with holding a gap therebetween; and applying a spinning process in such a manner as to have a gap between both end portions of the outer pipe and the reduced diameter portion in said inner pipe so as to compress both end portions of the outer pipe in a substantially taper shape, thereby closely attaching an inner surface of a front end portion thereof to an outer surface of the inner pipe or an interposed material.

4. A method of producing parts in an exhaust system as claimed in claim 3, wherein one of a heat insulating member and a damper member is inter-posed as the interposed material in at least a part between the inner pipe and the outer pipe at a time of fitting said outer pipe on the inner pipe.

* * * * *